United States Patent [19]

Goldenberg

[11] Patent Number: 4,614,309

[45] Date of Patent: Sep. 30, 1986

[54] RIGID LINK MULTIPLE DISK REFINER

[75] Inventor: Philip H. Goldenberg, Pittsfield, Mass.

[73] Assignee: Beloit Corporation, Beloit, Wis.

[21] Appl. No.: 651,868

[22] Filed: Sep. 18, 1984

[51] Int. Cl.[4] ..... B02C 7/16

[52] U.S. Cl. ..... 241/163; 241/261.2; 241/297

[58] Field of Search ..... 241/296, 297, 298, 287, 241/288, 289, 290, 261.2, 261.3, 163

[56] References Cited

U.S. PATENT DOCUMENTS

| | | | |
|---|---|---|---|
| 2,342,252 | 2/1944 | Claybourn et al. | 241/290 X |
| 3,448,934 | 6/1969 | Vaughan | 241/290 X |
| 4,081,147 | 3/1978 | Seifert et al. | 241/297 X |

*Primary Examiner*—Mark Rosenbaum

*Attorney, Agent, or Firm*—Hill, Van Santen, Steadman & Simpson

[57] ABSTRACT

A multiple disk refiner which includes a housing and a rotor hub mounted for rotation within the housing. A plurality of spaced refiner rotor disks are interleaved with spaced refiner stator disks, the pairs of disks being coaxial with the hub. The confronting faces of the stator disks and rotor disks have ribbed surfaces formed thereon for abrading and fibrillating a stock suspension as it passes in the spaces between the rotor and stator disks. The improvements of the present invention largely reside in a specific drive means for interconnecting the rotor and the rotor disks, the drive means including rigid links each of which has one end pivotally secured to the rotor and the other end pivotally secured to one of the rotor disks. A similar arrangement is provided utilizing rigid links for supporting the stator disks in proper position between the rotor disks while still providing some axial movement capability.

10 Claims, 5 Drawing Figures

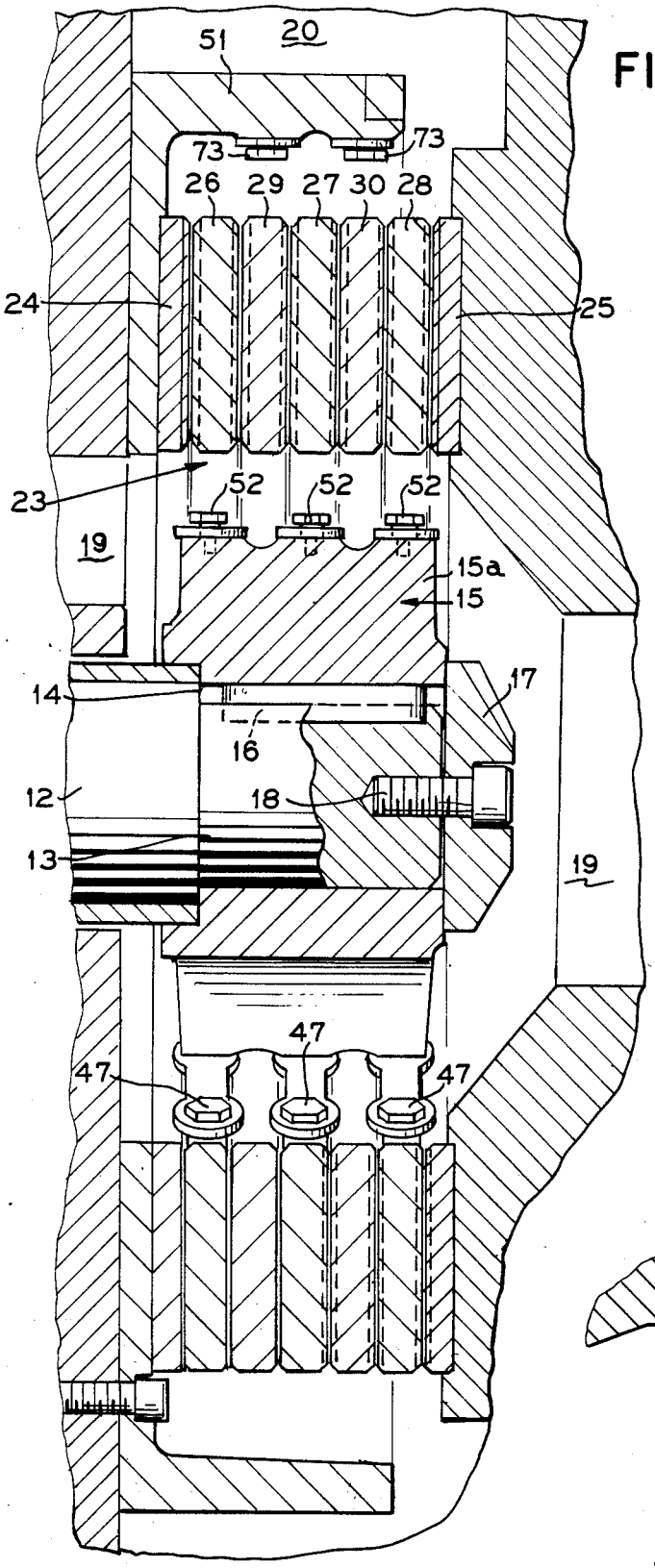
FIG. 3
FIG. 4
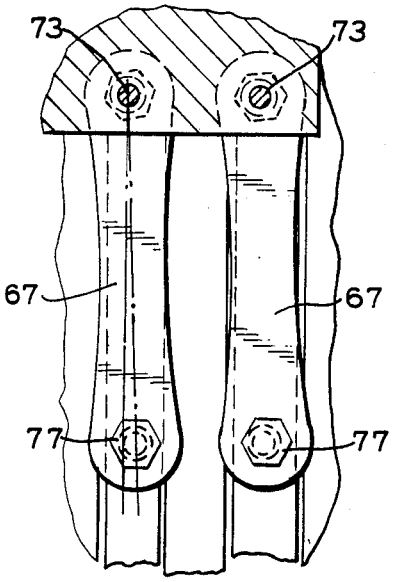
FIG. 5
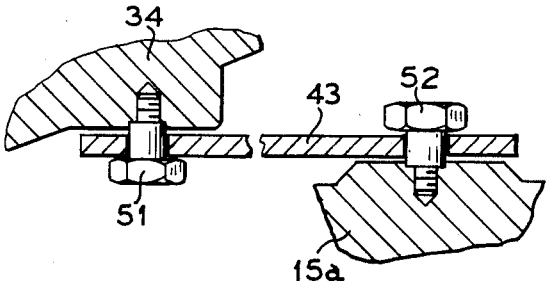

RIGID LINK MULTIPLE DISK REFINER

BACKGROUND OF THE INVENTION

1. Field of the Invention

The present invention is in the field of multiple disk refiners utilizing a large number of refiner disks some of which are rotatable relative to the others to provide for a very low intensity treatment of suspensions such as stock suspensions for the manufacture of paper. The invention involves the use of a rigid linkage to support and drive a large number of refining disks, permitting each to translate independently in the axial direction. The rigid linkage provides the required movement through the rotation at a pinned connection, thus eliminating large bending stress concentrations found in other support arrangements.

2. Description of the Prior Art

Paper stock, as it comes from beaters, digesters or other pulping machines is usually refined by passing the stock between grinding or refining surfaces which break up the fibrous materials and serve to create further separation and physical modification of the fibers.

A typical pulp refiner is disclosed in Thomas U.S. Pat. No. 3,371,873. This type of refiner includes a rotating disk which has annular refining surfaces on one or both sides. The disk refining surfaces are in confronting relation with non-rotating annular grinding surfaces and provide therebetween a refining zone in which the pulp is worked. The rotating disk and the refining surfaces are made of a substantially inflexible material such as cast iron or a hard stainless steel. The non-rotating grinding surfaces are made of similar material and are rigidly mounted so as to resist the torque created by the rapidly rotating disk and the pressure on the pulp material passing through the refining zone gap. Axial adjustment of the refining zone gaps is effected by axial shifting of the shaft on which the disk is mounted.

Rigid disk refiners of this type must be manufactured and assembled to close tolerances in order to set the refining zone gap width correctly. Because the loads supplied to the rigid disk are large during the refining process, a large and extremely rugged design is necessary so that the refining surface relationships do not change under load. This results in the rigid disk refiners being very costly due to the necessarily close tolerance machining, the need for large quantities of high-strength disk material, the bulky overall structure, the restrictive machine capacity, and the excessive assembly time requirements.

Substantial improvements in pulp refiners have been achieved with the development of the multiple disk refiner which operates at a low intensity. For example, in Matthew and Kirchner U.S. Pat. No. 4,531,681, issued July 30, 1985, entitled "Flexible Disk Refiner and Method" assigned to the same assignee as the present application, there is provided a refining apparatus including a plurality of radially extending, relatively rotatable and axially confronting refining surfaces between which the suspension must pass when being refined during relative rotation of the surfaces. Means are provided for effecting flow of the material radially between and across the surfaces. The drive means disclosed in that application involve the use of resiliently flexible support means which permit adjustment of the relatively rotating refining surfaces axially relative to each other depending upon the operating pressures, thereby achieving optimum material working results from the refining surfaces.

In a specific form of the invention disclosed in the aforementioned patent, there is provided a pulp refiner with ring-shaped refining surface plates of limited radial width which are mounted on interleaved margins of axially resiliently flexible or deflectable disk elements. Disk margins spaced from the interleaved margins on one set of the disk elements are secured to a rotor while the margins on another set of disks are secured non-rotatably or counterrotatably. The refining surface plates are made of a suitably hard, substantially rigid material. The disk elements, on the other hand, are made of axially resilient flexible material which strongly resists deformation of the radial and circumferential directions. Because of the manner in which the axially flexible disk elements are supported, there is an automatic axial self-adjustment of the refining surfaces during the pulp refining process for attaining pressure equalization and maintenance of substantially uniform gap widths between the rotating and non-rotating disk elements.

The multiple disk refiner represents a substantial improvement in the art of refining. It has been shown that with the use of a low-intensity, multiple disk refiner, pulp characteristics can be improved considerably over conventional refining techniques. Originally, such refiners were built using flexible diaphragms to restrain the refining disks and provide the torsional rigidity required to transmit rotational forces into the refining surfaces. The resiliency of the diaphragms permitted sufficient axial motion of the refiner disks such as required as each surface moves into close proximity to its adjacent neighbors as the refiner is loaded to its operational position.

It was found, however, that once a significant amount of wear occurred in the refining surface an additional amount of load was required to keep the surfaces within close proximity which reduced the ability of the refiner to provide low-intensity refining. Since the deflection occurring in a diaphragm is proportional to the cube of the load, it was determined that such a support was not optimum for a system subject to the amount of wear occurring in a commercial installation.

The type of prior art structures just described have met with some difficulties because of the various requirements which exist in industrial operation. While the diaphragm style supporting arrangement has proven to be effective in laboratory prototypes, further investigation has shown that this mechanism is not always completely effective when subjected to the expected axial deflection and torsional loads. Furthermore, the complicated mounting required provided considerable cost to the overall assembly.

One of the major difficulties involved the inability of the mechanism to withstand large torque reversals as sometimes occur accidentally during operation. This immediately contraindicated the use of many types of unidirectional arrangements as they would tend to buckle under such loads.

SUMMARY OF THE INVENTION

The present invention provides rigid linkages in the rotor disk and stator disk systems which offer several important advantages over previous arrangements. These advantages include improved axial flexibility, decreased stress in load-carrying members, and an improved simplicity which leads to reduced manufacturing cost and higher reliability.

The present invention which is characterized by a rigid link pivotal mechanism reduces the large bending stresses experienced by other arrangements during axial travel, permitting the motion to occur through a rotation of pinned connections of a rigid link. The state of stress in the link is very nearly constant and independent of the axial position of the disk assembly. The stress is almost purely a membrane stress due to the torsional loads with a small twisting stress imposed on it as the disk translates axially. This twisting stress is very nearly negligible even at the limit of axial travel. Since there is no requirement for the link to bend, the link can be made thick as well as rigid, supplying buckling resistance to help overcome the results of the large torque reversal previously described.

In accordance with the present invention, there is provided a multiple disk refiner comprising a housing and a hub mounted for rotation within the housing. A rotor is secured to the hub for rotation therewith, the rotor in the preferred form of the invention having a spoked configuration. A plurality of spaced refiner rotor disks extend in parallel spaced relation coaxially with the hub and a plurality of spaced refiner stator disks are in interleaved relation with the refiner rotor disks and are spaced therefrom to provide passages between the two sets of disks through which a suspension to be refined can be passed. Both the stator and rotor disks are provided with suitable ribs for abrading and fibrillating the fibers in the suspension.

A drive means is provided which interconnects the rotor and the rotor disks, the drive means including a plurality of rigid links each of which has one end pivotally secured to the rotor and the other end pivotally secured to one of the rotor disks. The refiner rotor disks are annular in configuration and the links are pivotally connected to the rotor disks at their inner diameters. Most conveniently, the drive means includes a plurality of shoulder bolts on the rotor and on each of the rotor disks, with rigid links extending between the shoulder bolts on the rotor and the rotor disks to drive the same.

Similarly, the stator disks may be mounted through the use of anchoring means on the housing which cooperate with rigid links which interconnect the anchoring means with the stator disks, each of the links being pivotally connected at its ends to the anchoring means and a stator disk, respectively. The system of the present invention employing the rigid link connections provides improved axial flexibility, decreased stress in load-carrying members, and a simplified arrangement resulting in reduced manufacturing cost and high reliability.

BRIEF DESCRIPTION OF THE DRAWINGS

A further description of the present invention will be made in conjunction with the attached sheets of drawings in which:

FIG. 3 is a fragmentary cross-sectional view taken substantially along the line III—III of FIG. 1;

FIG. 4 is a view partly in elevation and partly in cross section illustrating the manner in which the rigid links supporting the stator disks allow for the required movement; and FIG. 5 is a view on an enlarged scale illustrating the manner in which a rigid link interconnects the rotor and a rotor refiner disk.

DESCRIPTION OF THE PREFERRED EMBODIMENTS

Figure 1:
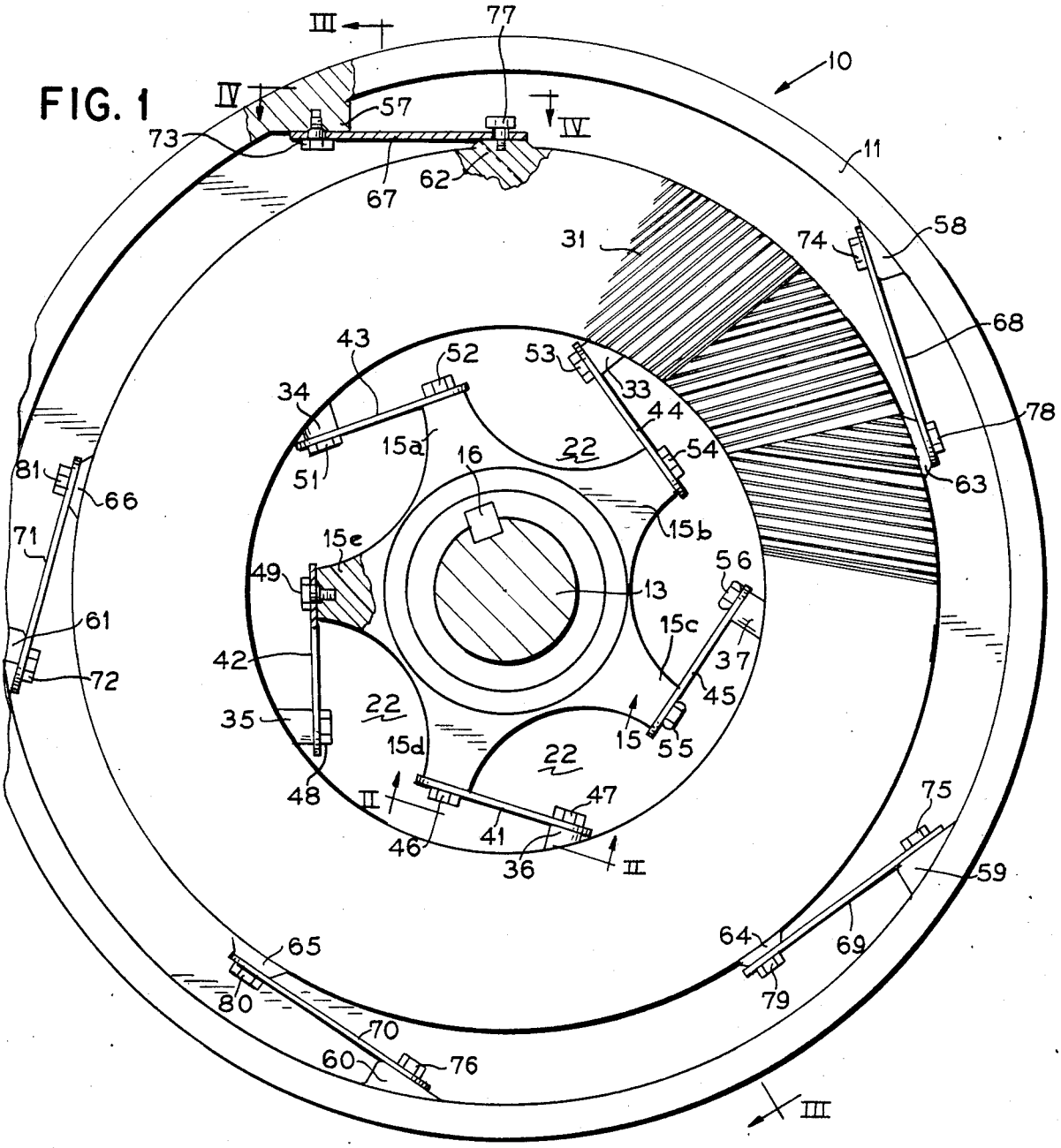
FIG. 1 is a side elevational view, partly in cross section, of a multiple disk refiner including the improvements of the present invention.

In FIG. 1, reference numeral 10 indicates generally a multiple disk refiner unit of the type used to refine pulp suspensions in the manufacture of paper. The refiner 10 includes an outer housing or cage 11.

A shaft 12 driven by a motor (not shown) has a reduced diameter hub portion 13 (FIG. 3) at the junction of which there is a locating shoulder 14. A rotor 15 has its axial movement limited by the locating shoulder 14 and is driven from the hub portion 13 through a key 16. A thrust plate 17 secured to the hub portion 13 by means of a bolt 18 closes the forward end of the assembly.

Stock suspension is introduced into the refiner through an inlet 19, which may be at the front or the back of the refiner or both, and is ultimately discharged through a discharge opening 20. The rotor 15 as best seen in FIG. 1 has spokes 15*a* through 15*e* extending radially therefrom, the spokes being separated by arcuate recesses 22 which help to channel the flow of the suspension into a refiner disk assembly generally indicated at reference numeral 23 in the drawings. The refiner disk assembly 23 includes a pair of end plates 24 and 25 which are stationarily secured to the housing 10. The particular device shown in the drawings includes refiner rotor disks 26, 27 and 28 separated by refiner stator disks 29 and 30. The stator and rotor disks are annular in configuration and contain abrading ribs 31 in confronting relation, some of the ribs being shown in FIG. 1. The stock suspension flows into the passages existing between the interleaved rotor and stator refiner disks to be abraded and fibrillated by the relative rotational movement between the rotor and stator disks before exiting at the discharge opening 20.

The annular rotor disks are provided at their inner peripheries with attachment means such as studs which are shown in FIG. 1 at reference numerals 33, 34, 35, 36 and 37. As seen in FIG. 1, the studs 33 through 37 are angularly disposed so that their axes are parallel with the axes of the spokes 15*a* through 15*e*, respectively. Both these axes are, in turn, perpendicular to the axis of the hub 13.

Figure 2:
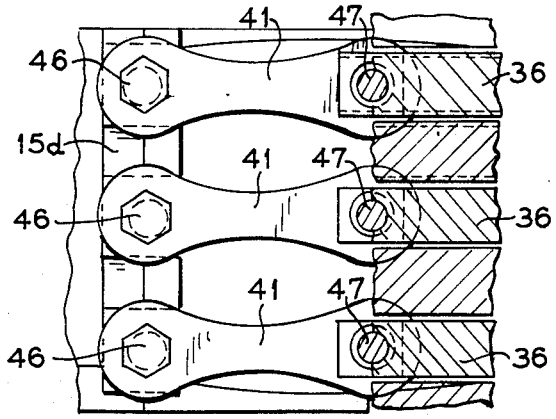
FIG. 2 is a view taken substantially along the line II—II of FIG. 1.

The rotor 15 is drivingly connected to the refiner rotor disks by means of rigid links best illustrated in FIGS. 1 and 2 of the drawings. Since there are three refiner rotor disks, 26, 27 and 28, each spoke 15*a* through 15*e* has three rigid links secured thereto, the links secured to the spoke 15*d* and to the attachment means or stud 36 being illustrated at reference numeral 41 in FIG. 2. Similarly, rigid links 42, 43, 44 and 45 connect the other spokes of the rotor 15 with the studs extending from the rotor disks. Pivotal movement to a slight but sufficient degree to accommodate axial shifting of the rotor disks relative to the stator disks is accomplished by securing the opposed ends of the links with shoulder bolts such as bolts 46 at one end of the links shown in FIG. 2, and shoulder bolts 47 shown at the other end. The links 42 are secured between the attachment means 35 and the spoke 15 by means of shoulder bolts 48 and 49, respectively, while links 43 are supported between the spoke 15*a* and the attachment means 34 by means of shoulder bolts 51 and 52. Shoulder bolts 53 and 54 connect the links 44 between the attachment means 53 and the spoke 15*b*. The rigid links 45 are supported between the spoke 15*c* and the attachment means 37 by means of shoulder bolts 55 and 56. A specific showing of the shoulder bolts is illustrated in FIG. 5 which illustrates the attachment of one of the links 43 between the spoke 15*a* and the attachment means 34.

The attachment of the stator disks is essentially similar and is best illustrated in FIGS. 1 and 4. Specifically, there are provided attachment means or lugs 57 through 61 spaced about the inner periphery of the housing 11. The stator disks are provided with projections 62 through 66 as best illustrated in FIG. 1 and rigid links 67 through 71 connect the stator disks with the attachment means located on the housing. Shoulder bolts 72 through 76 attach one end of the respective links to the housing or cage and shoulder bolts 77 through 81 secure the other ends to the stator disks. As illustrated in FIG. 4 by the dashed lines, the linkage is such as to provide a slight but effective amount of movement for the stator disks tending to compensate for irregularities of pressure distribution in the passages through which the stock suspension is flowing.

It will be noted that the pivotal points are located towards the inside diameter of the refiner rotor disks, thus enlarging the moment arm and reducing the link tension.

The present invention thus provides a rigid linkage to support and drive a large number of refining disks, allowing each to translate independently in the axial direction. The rigid linkage provides the movement through the rotation at a pinned connection. This eliminates large bending stresses found in other types of support arrangements.

The rigid linkage provides several important advantages over previously proposed arrangements. These include improved axial flexibility, decreased stress in load-carrying members, and overall simplicity which leads to reduced manufacturing cost and higher reliability. The invention can be adapted for use on counter-rotating refiners, and works well regardless of the number of cooperating refining disk pairs and regardless of the size of the refining disks. Thus, the invention can be used equally well on large and small refiners.

It will be evident that various modifications can be made to the described embodiments without departing from the scope of the present invention.

I claim as my invention:

1. A multiple disk refiner comprising:

a housing, a hub mounted for rotation within said housing, a rotor secured to said hub for rotation therewith, a plurality of spaced annular refiner rotor disks extending in parallel spaced relation coaxially with said hub, a plurality of spaced refiner stator disks in interleaved relation with said refiner rotor disks and being spaced therefrom to provide passages between confronting refiner rotor and stator disks through which a suspension to be refined can be passed, and drive means interconnecting said rotor and said rotor disks, said drive means including rigid links, each having one end pivotally secured to said rotor and the other end pivotally secured adjacent the inner periphery of one of said rotor disks, said links being secured to said rotor disks to provide a driving connection between said rotor and said disks while providing sufficient pivotal movement to accommodate slight axial shifting of said rotor disks relative to said stator disks along the rotary axis of said rotor disks.

2. A multiple disk refiner according to claim 1 which includes:

anchoring means on said housing, and rigid links interconnecting said anchoring means with said stator disks, each of said links being pivotally connected at its ends to said anchoring means and a stator disk, respectively.

3. A multiple disk refiner according to claim 1 wherein:

said refiner rotor disks are annular in configuration and said links are pivotally connected to said disks at their inner diameters.

4. A multiple disk refiner according to claim 1 wherein:

said drive means includes a plurality of shoulder bolts on said rotor and a shoulder bolt on each of said rotor disks, said rigid links extending between the shoulder bolts on said rotor and said rotor disks.

5. A multiple disk refiner according to claim 1 wherein:

said rotor has spokes extending therefrom with arcuate depressions between said spokes, said links being secured to the radial ends of said spokes.

6. A multiple disk refiner according to claim 1 wherein:

the axes of rotation of the pivotal connections between said links and said rotor and said links and said rotor disks are perpendicular to the axis of said hub.

7. In a multiple disk refiner including confronting stator and rotor refining disks having passages therebetween for the flow of a stock suspension therethrough, and a rotor for rotating said rotor disks relative to said stator disks, the improvement which comprises:

a drive system for interconnecting said rotor and said rotor disks, said drive system including a rigid link, and means providing a pivotal connection at both ends of said link to said rotor and to a rotor disk, respectively, said link providing a driving connection between said rotor and its associated rotor disk, said pivotal connection accommodating slight axial shifting of said rotor disks relative to said stator disks along the rotary axis of said rotor disks.

8. A multiple disk refiner according to claim 7 wherein:

said pivotal connection includes a shoulder bolt on both said rotor and said rotor disk and providing pivotal axes for the ends of said link.

9. A multiple disk refiner according to claim 8 wherein the axes of said shoulder bolts are parallel and both are perpendicular to the axis of said rotor.

10. A multiple disk refiner according to claim 7 wherein said rotor has spokes extending therefrom at whose ends said pivotal connections are located, and recesses between said spokes for directing flow of said stock suspension.

* * * * *